US009593885B2

(12) United States Patent
Cuerdon

(10) Patent No.: US 9,593,885 B2
(45) Date of Patent: Mar. 14, 2017

(54) AXIAL FAN INLET WIND-TURNING VANE ASSEMBLY

(71) Applicant: Martin J. Cuerdon, Frisco, CO (US)

(72) Inventor: Martin J. Cuerdon, Frisco, CO (US)

(73) Assignee: Advanced Analytical Solutions, LLC, Frisco, CO (US)

( * ) Notice: Subject to any disclaimer, the term of this patent is extended or adjusted under 35 U.S.C. 154(b) by 0 days.

(21) Appl. No.: 14/784,235

(22) PCT Filed: Aug. 29, 2014

(86) PCT No.: PCT/US2014/053353
§ 371 (c)(1),
(2) Date: Oct. 13, 2015

(87) PCT Pub. No.: WO2015/031723
PCT Pub. Date: Mar. 5, 2015

(65) Prior Publication Data

US 2016/0040937 A1 Feb. 11, 2016

Related U.S. Application Data

(60) Provisional application No. 61/872,499, filed on Aug. 30, 2013.

(51) Int. Cl.
*F04D 29/54* (2006.01)
*F28B 1/06* (2006.01)
(Continued)

(52) U.S. Cl.
CPC ..... *F28B 1/06* (2013.01); *E04H 5/12* (2013.01); *F01K 9/003* (2013.01); *F04D 29/541* (2013.01); *F28F 2250/08* (2013.01)

(58) Field of Classification Search
CPC ..... F03D 3/005; F03D 3/0409; F03D 1/04; F04D 19/00; F04D 19/002; F04D 29/002;
(Continued)

(56) References Cited

U.S. PATENT DOCUMENTS 2,169,232 A * 8/1939 Flanders ..... F04D 29/4213 415/173.1
2,217,608 A * 10/1940 Atchison ..... F04D 29/526 415/185
(Continued)

OTHER PUBLICATIONS

EBM-PAPST Inc., Informational "FlowGrid" .pdf file, located at ebm-papst Inc. product webpage http://www.ebmpapst.us/en/products/overview.html, pp. 1-8, last accessed on Oct. 15, 2015.

*Primary Examiner* — Richard Edgar
(74) *Attorney, Agent, or Firm* — Larson & Anderson, LLC

(57) ABSTRACT

An air-cooled heat exchange system includes a heat exchanger and an axial fan assembly. The heat exchanger has a heat exchange surface area. The axial fan assembly has a propeller-type impeller rotatably supported within an annular housing. The annular housing defines an air passageway from an air inlet end of the housing, across the impeller, and to an air outlet end of the housing. Rotation of the impeller within the annular housing causes air to flow into the air inlet end of the housing, along the air passageway, and out the air outlet of the housing. The axial fan assembly also has a wind-turning vane assembly extending beyond the air inlet end of the annular housing.

36 Claims, 12 Drawing Sheets

(51) Int. Cl.
*E04H 5/12* (2006.01)
*F01K 9/00* (2006.01)

(58) Field of Classification Search
CPC ..... F04D 29/52; F04D 29/522; F04D 29/54; F04D 29/541; F04D 29/545; F04D 29/547
USPC ..... 415/208.1, 220
See application file for complete search history.

(56) References Cited

U.S. PATENT DOCUMENTS 2,258,731 A * 10/1941 Blumenthal ..... F21V 33/0096 261/30
2,330,907 A * 10/1943 Dodge ..... B64C 11/001 415/185
2,601,947 A * 7/1952 Buttner ..... F04D 29/703 415/121.2
2,907,554 A 10/1959 Heller
4,211,514 A 7/1980 Hawes
4,548,548 A 10/1985 Gray
4,905,474 A * 3/1990 Larinoff ..... F28B 9/10 165/111
5,411,224 A 5/1995 Dearman et al.
5,423,660 A * 6/1995 Sortor ..... F01P 5/06 416/189
5,452,713 A * 9/1995 Vipond ..... F04D 29/545 128/202.27
5,662,079 A 9/1997 Snider
6,045,327 A 4/2000 Amr
6,193,011 B1 2/2001 Harris
6,302,640 B1 10/2001 McKelvey
6,942,200 B2 9/2005 Gu
7,220,102 B2 5/2007 Cho et al.
7,400,057 B2 7/2008 Sureshan
7,513,741 B2 4/2009 Smiley, III et al.
8,100,645 B2 1/2012 Taylor
8,302,670 B2 11/2012 Yang et al.
8,444,754 B2 5/2013 June et al.
8,678,762 B1 3/2014 Baker
8,776,545 B2 7/2014 Blockerye
2005/0006050 A1 1/2005 Schrey et al.
2010/0068052 A1 3/2010 Werle et al.

* cited by examiner

Axial Fan Wind Turning Vane Test Apparatus

| Item | Description |
|---|---|
| 1 | Primary Fan |
| 2 | Secondary Fan |
| 3 | Wind Turning Vane |
| 4 | Air Velocity Sensor |
| 5 | Air Velocity Meter |

80 mm Computer Fan Output Air Velocity
Versus Distance From Fan Centerline

Fig. 6: 80 mm Computer Fan Output Air Velocity Versus Distance From Fan Centerline
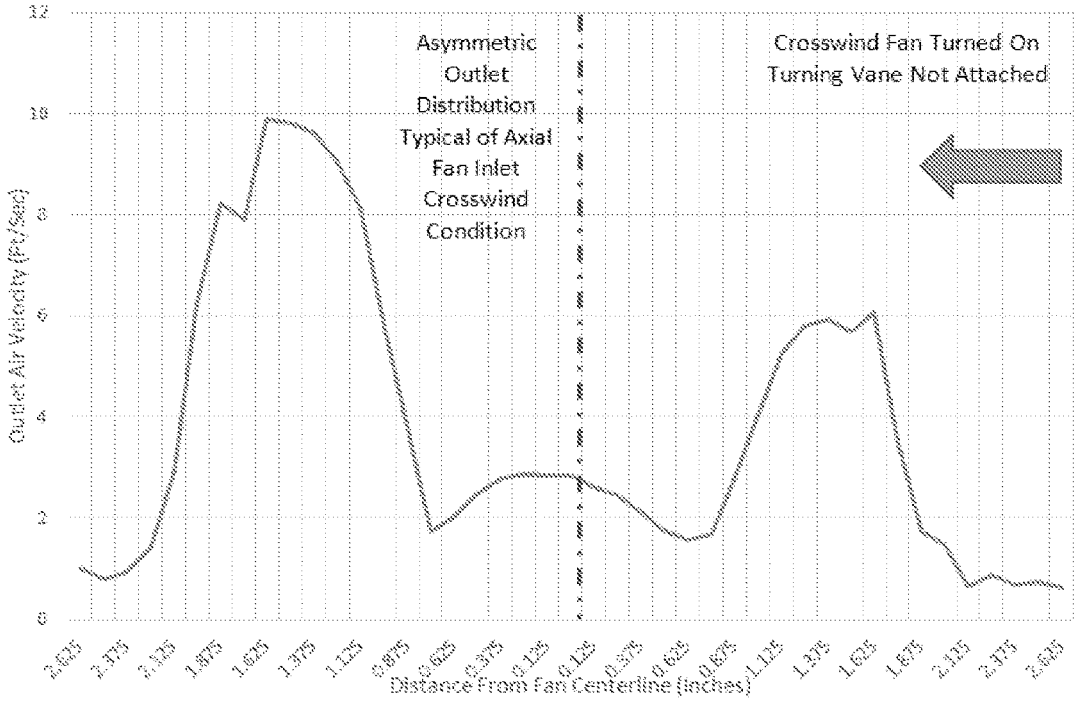

Fig. 7: 80 mm Computer Fan Output Air Velocity Versus Distance From Fan Centerline
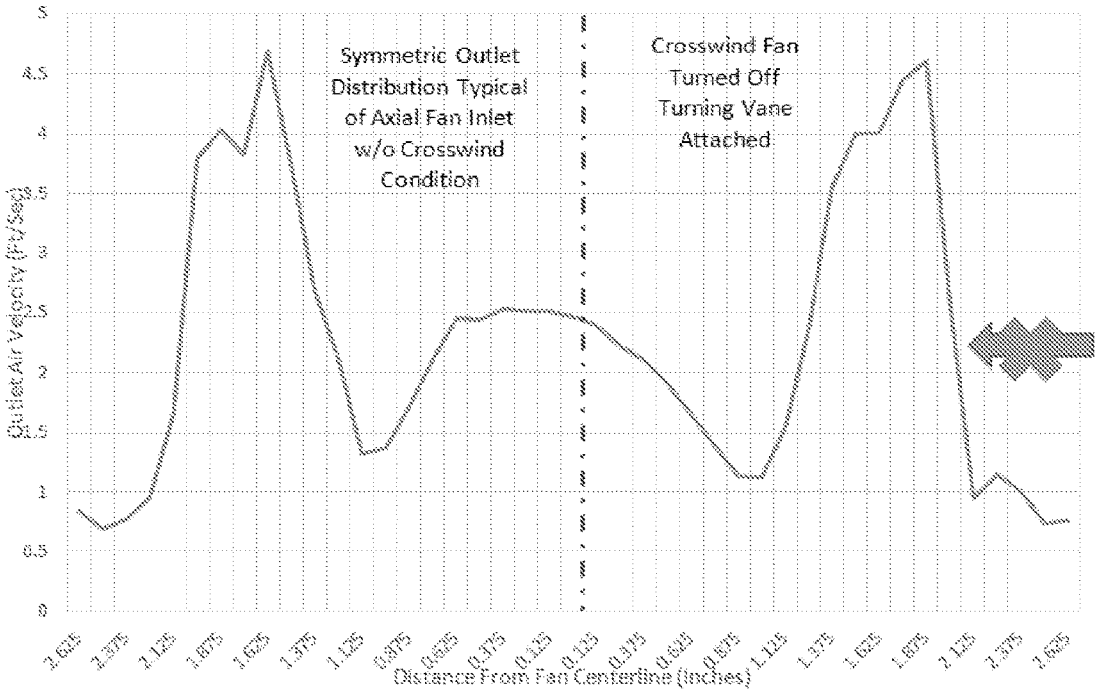

Fig. 8: 80 mm Computer Fan Output Air Velocity Versus Distance From Fan Centerline
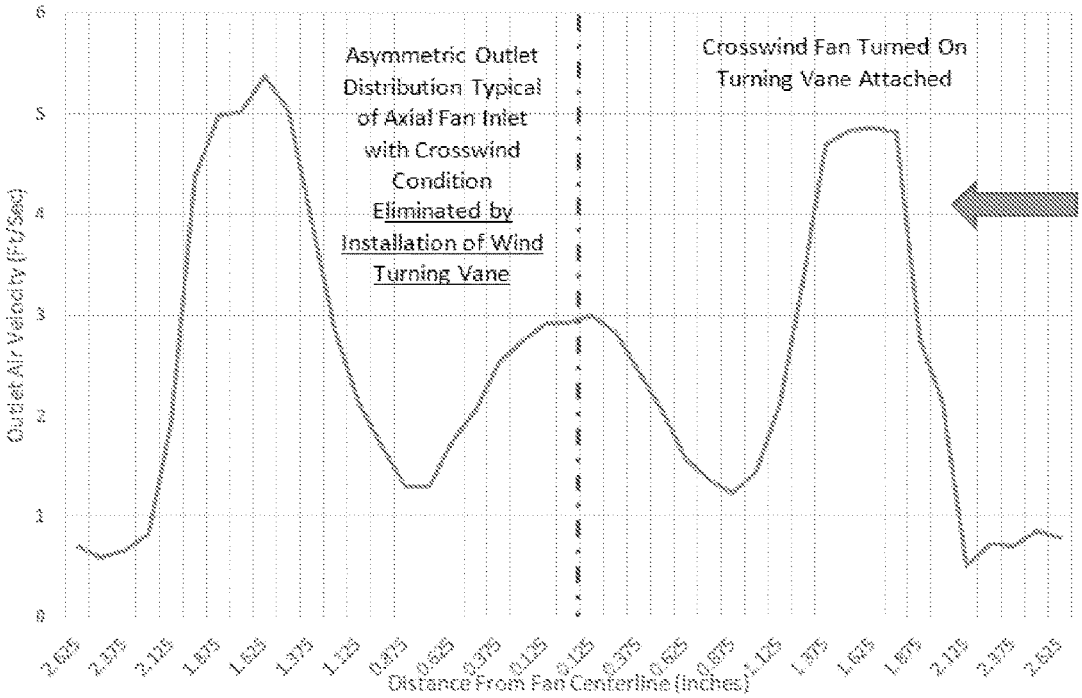

AXIAL FAN INLET WIND-TURNING VANE ASSEMBLY

BACKGROUND

Axial fan assemblies are known in the art and are essentially a propeller-type impeller rotatably supported within an annular housing. The diameter of the annular housing is sized to provide a small tip clearance from the end of the propeller-type impeller and provides an air passageway from an inlet end to an outlet end of the housing. Rotation of the impeller causes air to enter the inlet end, pass along the air passageway and across the impeller, and exit the outlet end of the housing.

Axial fan assemblies are employed for a variety purposes and in various environments. One particular application of axial fan assemblies is for providing air flow in air-cooled heat exchanger systems (e.g. fin-fan coolers and steam condensers). For example, air-cooled steam condensers are used in electric power generation plants. In these plants axial fan assemblies are employed to pass ambient air across heat exchangers to condense turbine exhaust steam exiting the final stages of expansion processes in the power plant into liquid water to be reused in the plant.

U.S. Pat. Nos. 8,302,670 and 8,776,545 and US Patent Application Publication No. 2005/0006050, which all are incorporated herein by reference in their entirety for all purposes, describe uses of axial fan assemblies disposed in arrays for heat exchange with steam exiting power generation plants (e.g. air-cooled condensing systems, or ACCs). Typically, at electric power generation plants that employ air-cooled condensers, a plurality of axial fan assemblies are configured in an array located outside of the plant. Turbine exhaust steam from the plant is piped to heat exchangers positioned adjacent to and/or above the outlet ends of housings of the assemblies in the array. The array of axial fans and associated heat exchangers are supported by a support structure so that the axes of the assemblies are vertical with the inlets pointed toward and positioned between about 20 and 150 feet from the ground. Ambient outside air is caused to flow in a vertical direction across the heat exchanger(s) by each axial fan assembly disposed in the array, thereby cooling the steam in the heat exchanger and condensing it into liquid water, which is piped back to the plant for reuse in the electric power generation process.

Problems with axial fan assemblies are well known in the art. For example, when axial fan assemblies are employed in air-cooled condensing systems at electric power generation plants, the cooling load is supplied by ambient air from the outside environment. Thus, the axial fan assemblies performance, and the plant's performance is largely dependent upon environmental conditions, such as ambient temperature, outside of the plant. Additionally, due to the size of the propeller-type impellers of these assemblies (e.g. 5'-20', or more, per radial blade) and the RPMs (e.g. from about 10-200 RPMs, for example about 100 RPM) required to produce satisfactory air flow across the heat exchangers, if a blade breaks during operation, it can become a missile with a potential projectile path of any of the 360°s in its path of rotation. If a blade breaks it could be thrown into and damage an adjacent axial fan assembly in the array or be thrown elsewhere and cause damage to person or other property. Furthermore, the vibration caused by the unbalanced forces in the fan with the broken blade often destroys the remaining blades in the particular assembly. Damage to one or more axial fan assemblies requires shut down of the respective assembly, reduction in electric power output, and potentially shut down of the entire electric power generation plant. The present invention provides solutions to these and other problems.

SUMMARY OF THE INVENTION

The present Inventor has noted that axial fan blade breakage can be caused by axial inlet air flow distortion and herein provides solutions to these problems. In particular the present Inventor has discovered that the environmental condition of wind turning from the ambient horizontal orientation to a different direction (e.g. a vertical orientation) as it enters an axial fan assembly's annular space results in boundary layer distortion and separation on the interior surface of the annular housing of an axial fan assembly. This boundary layer distortion and separation creates a pressure differential(s) within the housing of the assembly and this pressure differential can cause cyclical propeller-type impeller blade stress which can lead to blade failure as well as a decreased axial fan performance.

The present Inventor has likewise discovered solutions to these wind-created problems with axial fan assemblies which include use of a wind-turning vane assembly at the inlet end of the annular housing of an axial fan assembly. Without being bound by a particular mechanism of action, it is believed that the wind-turning vane assemblies disclosed herein make use of the force of the wind to elevate air pressure at the windward side of the inlet end of the annular housing. The wind-turning vane assembly also causes the wind flowing to the down-wind side of the axial fan inlet to take a longer and more complex path thereby reducing the elevated pressure region on the down-wind side of the axial fan inlet. Elevation of air pressure at the windward side of the inlet end with simultaneous reduction of the air pressure on the down-wind side of the annular housing promotes increased airflow into the annular housing at its windward side thereby reducing and/or eliminating the pressure differential across the interior of the housing created by wind.

It has further been found that reduction and/or elimination of the wind-created pressure differential via the wind-turning vane assemblies herein described allows for an increase in axial fan performance and efficiency when wind is impacting the exterior of the axial fan housing. Without being bound by a particular mechanism of action, it is believed that the wind-turning vane assemblies herein described make use of kinetic energy of wind and increase the volumetric output of the axial fan assembly by turning wind from its ambient direction (e.g. horizontal) into a direction which is substantially parallel to the axis of the annular housing of the fan assembly.

Axial fan assemblies are known in the art to produce noise during operation and the noise increases in the presence of non-axisymmetric intake air flow conditions. This invention reduces non-axisymmetric intake air flow condition and thereby reduces the associated noise contribution.

In a first aspect, the present invention provides an air-cooled steam condensing system comprising:

(A) a heat exchanger having a heat exchange surface area, (B) an axial fan assembly comprising:

(i) a propeller-type impeller rotatably supported within an annular housing, the annular housing defining an air passageway from an air inlet end of the housing, across the impeller, and to an air outlet end of the housing, wherein rotation of the impeller within the annular housing causes air to flow into the air inlet end of the housing, along the air passageway, and out the air outlet of the housing, and (ii) a wind-turning vane assembly extending beyond the air inlet end of the annular housing, the turning vane assembly comprising a wind-turning vane concentrically arranged about the axis of the annular housing, wherein the radius of concentric arrangement of the wind-turning vane is less than the radius of the annular housing, wherein the outlet end of the annular housing of the (B) axial fan assembly is positioned to pass air exiting the outlet end of the annular housing across the heat exchange surface area of the (A) heat exchanger.

In a second aspect, the present invention provides an axial fan assembly comprising:

(i) a propeller-type impeller rotatably supported within an annular housing, the annular housing defining an air passageway from an air inlet end of the housing, across the impeller, and to an air outlet end of the housing, wherein rotation of the impeller within the annular housing causes air to flow into the air inlet end of the housing, along the air passageway, and out the air outlet of the housing, and (ii) a wind-turning vane assembly extending beyond the air inlet end of the annular housing, the turning vane assembly comprising a wind-turning vane concentrically arranged about the axis of the annular housing, wherein the radius of concentric arrangement of the turning vane is less than the radius of the annular housing.

In a third aspect, the present invention provides a method of using the system or axial fan assembly in accordance with either the first or second aspects of the present invention. In this third aspect the impeller of the axial fan assembly is rotated within the annular housing to cause air to flow into the air inlet end of the housing, along the air passageway, and out the air outlet of the housing. Furthermore, the annular housing and wind-turning vane assembly of the axial fan assembly are exposed to environmental conditions including impaction thereof by wind.

In a fourth aspect, the present invention provides a wind-turning vane assembly for reducing a wind-created air pressure gradient across an air passage defined by an annular housing of an axial fan assembly, the wind-turning vane assembly being attachable to the inlet end of the annular housing of the axial fan assembly and comprising:

a wind-turning vane concentrically arranged about a central axis of the wind-turning vane assembly, wherein:

the radius of the concentric arrangement of the turning vane is less than the radius of the annular housing of the axial fan assembly; and when the turning vane assembly is attached to the inlet end of the annular housing of the axial fan assembly, the central axis of the turning vane assembly is aligned with the central axis of the annular housing of the axial fan assembly and the wind-turning vane assembly extends from the axial fan assembly beyond the inlet end of the annular housing.

In a fifth aspect, the present invention provides a method of operation of an axial fan assembly, the method comprising:

(i) providing an axial fan assembly having a propeller-type impeller rotatably supported within an annular housing, the annular housing defining an air passageway from an air inlet end of the housing, across the impeller, and to an air outlet end of the housing, (ii) rotating the impeller within the annular housing to cause air to flow into the air inlet end of the housing, along the air passageway, and out the air outlet of the housing, and (iii) exposing the axial fan assembly to wind thereby creating a windward side of the assembly, (iv) using the force of the wind to elevate air pressure at the windward side of the air inlet of the air passageway defined by the annular housing and preferably to decrease air pressure at the leeward side of the air inlet of the air passageway defined by the annular housing.

BRIEF DESCRIPTION OF THE DRAWINGS

FIGS. 5-8 show graphical results from the bench testing of the test apparatus shown in FIG. 4 and used and described in the Example Section of the application.

DETAILED DESCRIPTION OF THE INVENTION

Figure 1A:
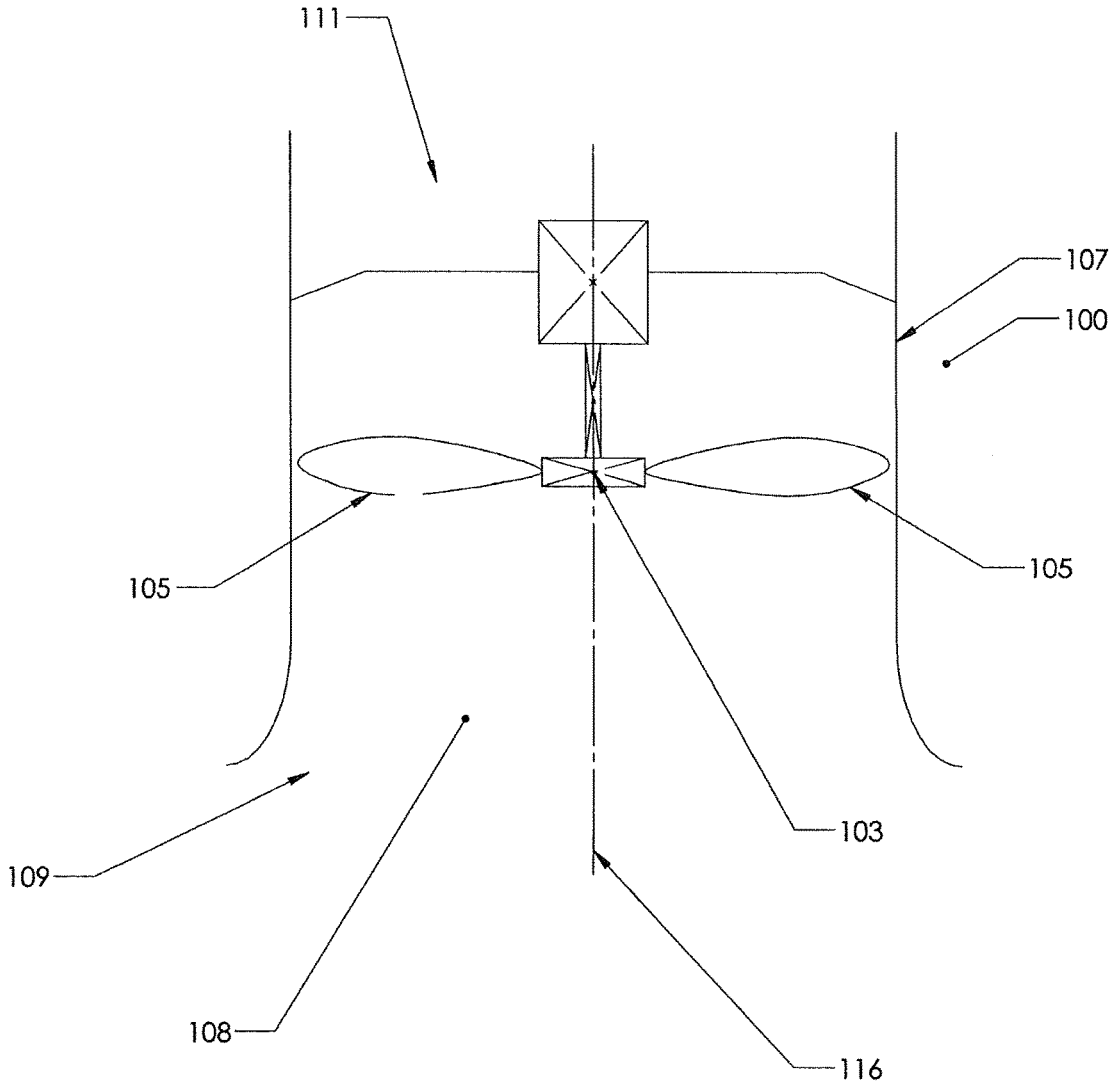
FIG. 1A is a side view of an axial fan assembly.

As shown in FIG. 1, an axial fan assembly 100 includes a propeller-type impeller 103 having a plurality of propeller blades 105 (e.g. between 2 and 12, for example between 4 and 10, such as 6 or 8 blades) that are rotatably supported within an annular housing 107. The housing provides an air passageway 108 from an inlet end 109 of the housing 107, across the impeller 103, to an outlet end 111 of the housing 107. Rotation of the propeller-type impeller 103 causes air to enter the inlet end 109, pass along the air passageway 108 and across the impeller 103, and exit the outlet end 111 of the housing 107. In a typical axial fan assembly 100, the axis of rotation 116 of the impeller is coextensive with the axis 116 of the annular housing 107. The outlet end 111 of the annular housing 107 of a typical axial fan assembly 100 is positioned to direct the outlet airflow in an intended direction for a specific purpose. While rotation of the impeller in a reverse or opposite direction than that intended (e.g. counterclockwise compared to clockwise rotation, or vice versa) might cause air to flow backward along the air passageway defined by the annular housing, this type of operation is not preferred when the outlet air flow of axial fan is designed and/or positioned for a particular purpose.

Figure 1B:
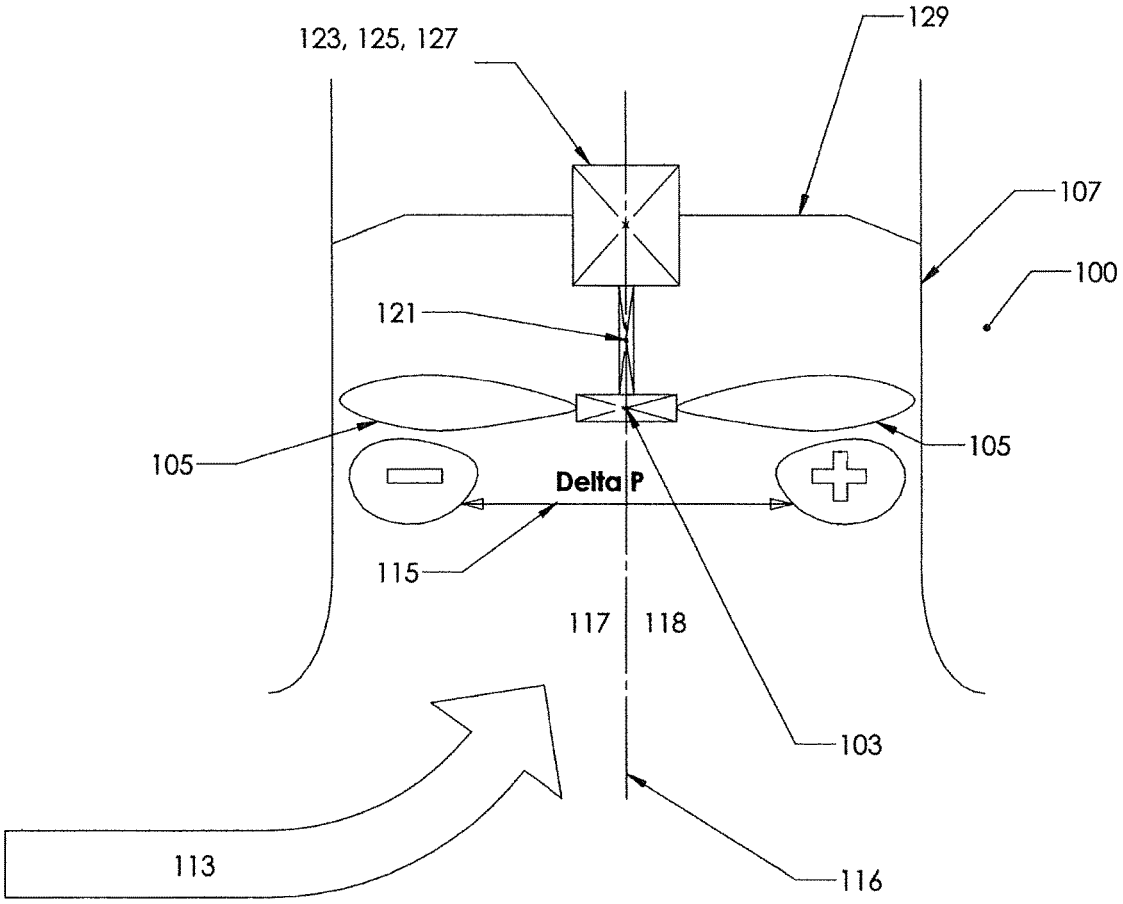
FIG. 1B is a side view of an axial fan assembly demonstrating the effect of wind turning into the axial fan inlet as it crosses the edge of the external surface of the annular housing.

As shown in FIG. 1B, it has herein been discovered that the environmental condition of wind 113 turning from the ambient horizontal orientation to a different direction (e.g. to a vertical orientation) as it enters the axial fan assembly annular space 108 results in boundary layer distortion and separation on the interior surface of the annular housing of an axial fan assembly 100. This boundary layer distortion and separation causes a pressure differential(s) 115 within the housing 107 of the assembly 100 and this pressure differential 115 can cause cyclical propeller-type impeller blade 105 stress leading to blade 105 failure as well as a decreased axial fan 100 performance.

Without being bound by a particular mechanism, it is believed that when wind 113 is from a given direction not parallel to the axis 116 of the annular housing of the axial fan assembly it will turn (e.g. for example 90°, where the axis of the annular housing is vertical) across the edge of the annular housing 107 into a direction substantially parallel to the axis of the annular housing/axial fan assembly. The aerodynamic boundary layer created on the inside surface of the annular housing 107 will be disrupted by the turning wind. Furthermore, the disrupted boundary layer will shed and create vortices in the annular housing 107 air flow. The momentum of the turning air and the vortices will create the herein described air pressure differential 115 across the interior of the annular housing 107. In axial fan assemblies 100 having an annular housing 107 with an vertical axis 116 (such as those using in air-cooled steam condenser arrays employed at power plants), wind 113 crosses the edge of the annular housing at a direction substantially perpendicular (e.g within +/−5° of perpendicular) to the axis 116 of the annular housing 107.

The direction and magnitude of the air pressure differential 115 across the interior of the annular housing 107 caused by wind is variable with inter alia the direction and intensity of the wind 113. When there is minimal to no wind 113, the pressure differential 115 across the interior of the housing 107 and associated blade 105 stresses caused by the differential 115 are negligible. However, as wind 113 speed increases and wind 113 sweeps away the boundary layer air pressure is reduced on the interior of the windward side of the housing. At the same time air pressure is increased on the interior of the leeward side of the interior of the housing as a result of momentum of the turning wind on leeward side of the interior of the housing 107.

The present Inventor has discovered that operation of the axial fan assembly (e.g. rotation of the axial fan blades 105 within the annular air passage 108 of the housing 107) during times where the wind-caused pressure gradient 115 is present causes several problems as a result of the cyclical contact of the blades 105 with regions of different air pressure/density across the axis 116 of the annular air passage 108 and axis 116 of rotation of the impeller (e.g. higher air pressure region corresponds with higher air density and vice versa).

First, when a fan blade 105 enters a region of different air pressure from where it came during its cyclical rotation about the axis 116, the fan blade 105 bends creating undesirable cyclical stresses on the fan blade 105. For example, as the blade 105 moves from a lower pressure to a higher pressure region the fan blade 105 draws more air and bends toward the air inlet 109 of the housing 107. Furthermore, and vice versa, as the blade 105 moves from a higher pressure to a lower pressure region the fan blade 105 stalls (e.g. draws less air) and bends toward the air exit 111 of the housing 107. These events create undesirable cyclical stresses on the fan blade 105 as it travels in its cyclical rotation about the axis 116 of the annular housing 107 which can cause fatigue of the fan blade 105 material and eventually failure of the fan blade 105.

Second, shedding of the above-described boundary layer will occur at different rates at different points along the interior surface of the annular housing due to the wind-created pressure differential. A recently shed boundary layer air fragment has a lower velocity relative to the higher velocity non-boundary layer air stream. The recently shed boundary layer fragment moves away from the surface and the top portion of the fragment is induced to rotate into an eddy or vortice by the higher velocity non-boundary layer air stream. This phenomena is known as von Karmen vortices. The vortices are periodic with a frequency related to the air speed. The now vortice laden air stream creates turbulence and pressure distortions causing the fan blades to be dynamically loaded when they encounter the vortices. Separating boundary layer also significantly increases aerodynamic drag thus reducing the axial fan volumetric efficiency. This boundary layer shedding occurs at a greater frequency on the inside surface along the windward portion of the annular housing due to the reduced air pressure as compared to the leeward side of the interior surface of the housing. Thus, the frequency of episodic vortex creation occurs inversely with localized pressure. The lower pressure windward side of the annular housing chamber experiences a higher frequency of vortex creation than the high pressure leeward side creating dynamic localized air pressure distortions and causing the fan blades to undergo highly unbalanced aerodynamic forces.

Third, the fan blades 105 are typically radially connected to a central fan hub which is rotationally supported via a shaft 121, gear box 123, bearing assembly(ies) 125, and a motor 127 which in turn are supported within the air passage 108 of the annular housing 107 via a fan bridge 129 spanning the width of the annular housing 107. When a fan blade 105 enters a region of different air pressure from where it came during its cyclical rotation the moment of inertia of the fan blade 105 is altered thereby creating moment forces about the central fan hub which are absorbed by the fan blade, the central fan hub, the fan shaft, the gear box, the bearing assembly(ies), the motor, the fan bridge, and/or any other supporting structure to which these devices are attached. Absorption of these cyclical moment forces can lead to structural fatigue and failure of any of these devices or their associated parts. The problem of the rotational moment forces can be exacerbated depending on the radial positioning/spacing of other fan blades 105 about the central hub where the other fan blade(s) 105 enter an opposing region of the wind-created pressure gradient within the annular air passage 108 of the fan assembly 100 causing an opposite direction force and thereby adding to the moment of inertia about the central fan hub at a different position within the annular housing 107.

Fourth, when the wind-caused pressure gradient 115 is present within the annular air passage 108 of the annular housing 107, there is a decrease in air flow generated by the axial fan assembly 100 (as compared to operation of the assembly in decreased/no wind conditions). This is a problem particularly where processes rely upon the air flow created by the axial fan assembly 100. For example, in the power generation plant scenario outlined herein, plant efficiencies are dependent upon the ability to cool and condense waste steam exiting the facility. Back pressure on the turbine exhaust steam line coming from the plant results in reduced expansion work available for power generation coming from the final turbines in the plant and hence reduces the total expansion work available to create energy from the steam. This leads to plant electrical power output reduction and thermodynamic inefficiencies.

All of the above-outlined problems can be further exacerbated when the wind changes direction and/or intensity/speed. The present invention provides solutions to overcome the above-outlined problems associated with wind 113 turning at the windward edge of the annular housing 107 of axial fan assemblies. In particular, the present Inventor has discovered that the above-described pressure gradient 115 across the axis 116 of the annular housing resulting from wind turning at the windward edge of the annular housing can be reduced and/or eliminated by using the force of the wind 113 to elevate or create a region(s) of elevated pressure at the windward side 117 of the inlet end 109 of the air passage 108 of the annular housing 107 while at the same time decreasing pressure at the leeward side 118 of the air passage. Without being bound by a particular mechanism of operation, it is believed that by elevating or creating a region of elevated pressure at the windward side 117 of the inlet end 109 of the air passage 108 the annular housing 107, air is caused to flow into the windward side 117 of the inlet 109 of the air passage 108, thereby reducing, eliminating, and/or otherwise overcoming the wind-created pressure gradient 115 across the axis/air passage of the annular housing 107.

DEFINITIONS

As used in the specification and claims of this application, the following definitions, should be applied.

"a", "an", and "the" as an antecedent refer to either the singular or plural. For example, "an assembly" refers to either a single species or a combination of assemblies unless the context indicates otherwise.

The term "wind" as used herein is understood to mean the environmental condition of horizontal air movement along (e.g. or substantially parallel to) the earth's surface. The term "wind" as used herein does not refer to the airflow created or caused by rotation of the impeller 103 of the axial fan assembly 100 (e.g. airflow into the inlet end 109 of the annular housing 107 and/or airflow out of the outlet end 111 of the annular housing 107 caused by rotation of the impeller). "Wind" in certain embodiments and in the context of this definition also could be an artificially caused non-axisymmetric intake air flow resulting in an axial fan inlet pressure gradient analogous to the natural wind condition.

The term "beyond" as used with respect to placement of wind-turning vane assembly with respect to the air inlet end of the annular housing, is herein understood to mean that the wind-turning vane assembly extends outside of the housing and past the inlet end of the housing.

Reference throughout the specification to "one embodiment," "another embodiment," "an embodiment," "some embodiments," and so forth, means that a particular element (e.g., feature, structure, property, and/or characteristic) described in connection with the embodiment is included in at least one embodiment described herein, and may or may not be present in other embodiments. In addition, it is to be understood that the described element(s) may be combined in any suitable manner in the various embodiments.

Unless indicated to the contrary, any numerical value described herein should be understood to include numerical values which are the same when reduced to the same number of significant figures and numerical values which differ from the stated value by less than the experimental error of conventional measurement technique of the type described in the present application to determine the value.

A Method of Operating an Axial Fan Assembly:

In one aspect, the present invention provides a method of operation of an axial fan assembly, the method comprising:

(i) providing an axial fan assembly having a propeller-type impeller rotatably supported within an annular housing, the annular housing defining an air passageway from an air inlet end of the housing, across the impeller, and to an air outlet end of the housing, (ii) rotating the impeller within the annular housing to cause air to flow into the air inlet end of the housing, along the air passageway, and out the air outlet of the housing, and (iii) exposing the axial fan assembly to wind thereby creating a windward side of the assembly, (iv) using the force of the wind create a region of elevated pressure at the windward side of the air inlet of the air passageway defined by the annular housing. In a preferred embodiment the force of the wind is used to also decrease air pressure at the leeward side of the air inlet of the air passageway defined by the annular housing. In a further preferred embodiment, the force of the wind is used to increase volumetric output of the axial fan assembly.

Step (iv) is preferably accomplish by attaching a wind-turning vane assembly to the inlet end of the housing as described herein.

Wind-Turning Vane Assembly:

In another aspect of the present invention, a wind-turning vane assembly is provided for attachment to an axial fan assembly and/or be positioned in fluid communication with the inlet end of the air passageway defined by the annular housing the axial fan assembly. The wind-turning vane assembly can be an after-market part sold separately from axial fan assemblies, or it can be incorporated onto axial fan assemblies during manufacture thereof. For example, an axial fan assembly can be retrofit in its operating location (e.g. on site in its industrial location, e.g. at a power plant) with a wind-turning vane assembly as herein described. In the alternative the axial fan assembly can be manufactured and/or otherwise shipped together with a wind-turning vane assembly as herein described.

Figure 2A:
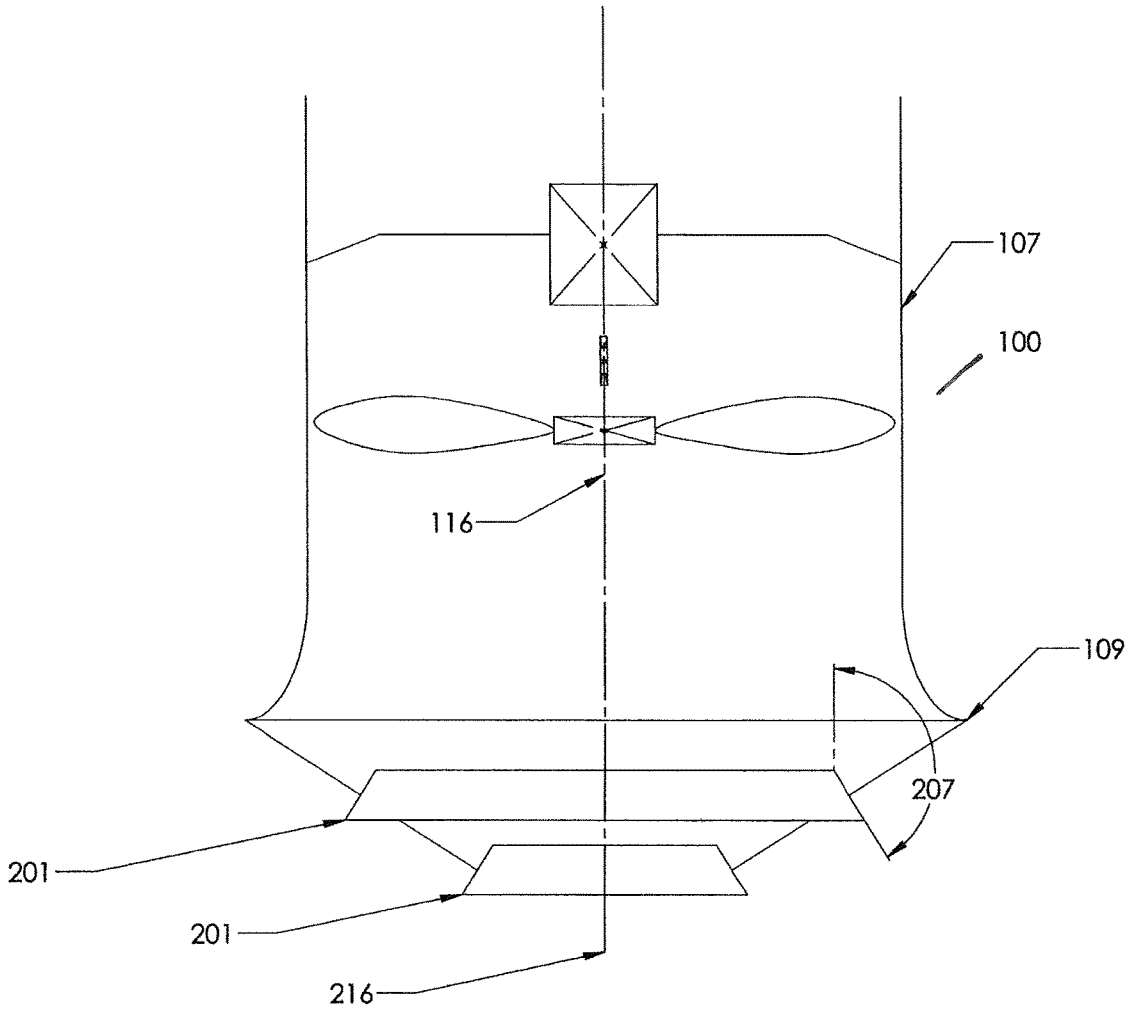
FIG. 2A is a side view of an axial fan assembly with a turning vane assembly according to the present invention.
Figure 2B:
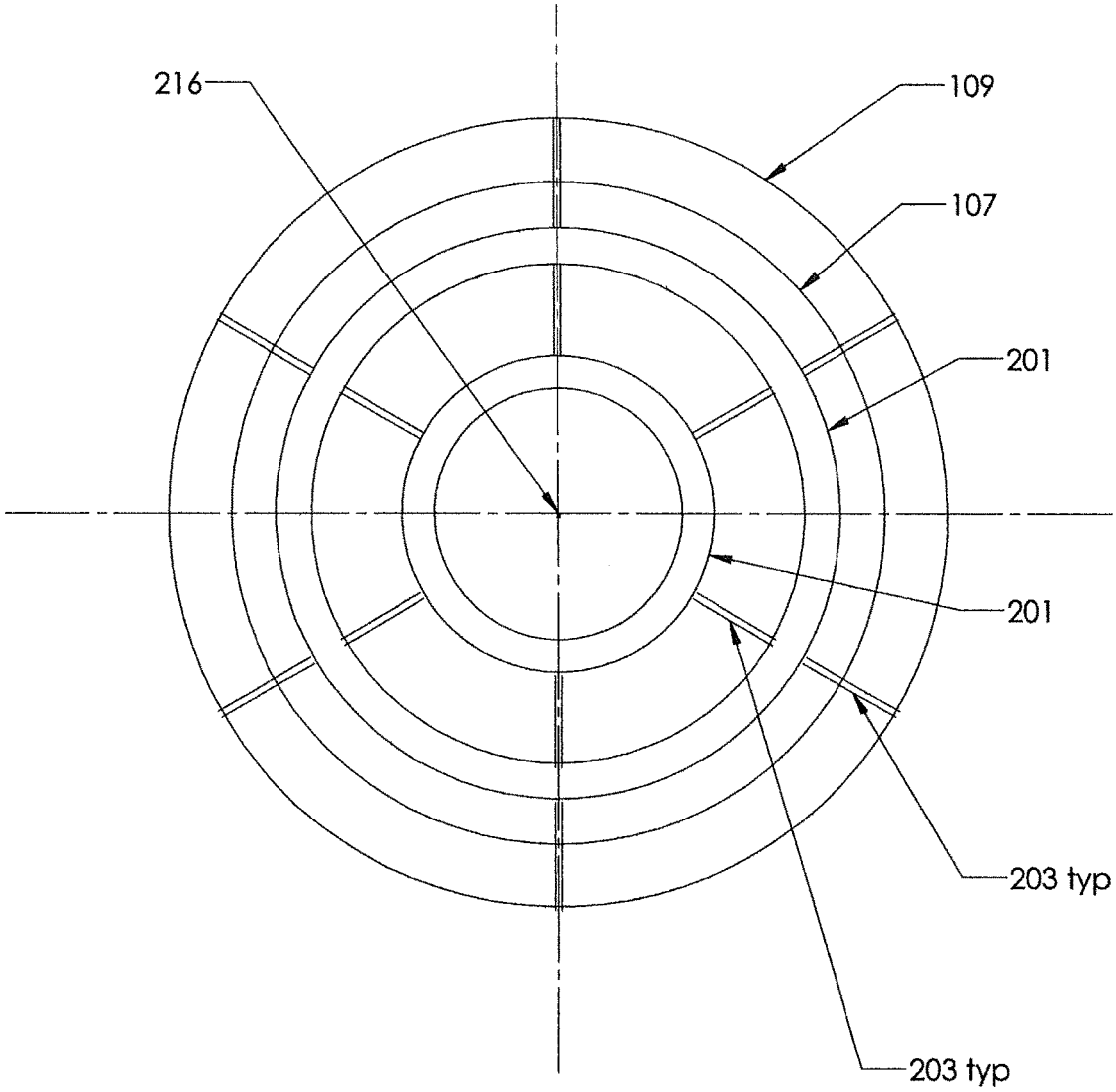
FIG. 2B is a bottom view of an axial fan assembly with a turning vane assembly according to the present invention.

Various embodiments of the wind-turning vane assembly, and applications thereof, are described herein and in more detail in other aspects of the present invention described throughout the application. The wind-turning vane assembly is suitable for reducing the wind-created air pressure gradient across the air passage defined by the annular housing of an axial fan assembly which is described above. As shown in FIGS. 2A and 2B, in one embodiment, the wind-turning vane assembly 200 is attachable to any axial fan assembly 100 as described herein and extends outwardly from the inlet end 109 (away from the outlet end) of the annular housing 107 when attached to the axial fan assembly 100. The turning vane assembly 200 comprises: at least one wind-turning vane 201, and more preferably a plurality of wind-turning vanes 201, concentrically arranged about a central axis 216 of the wind-turning vane assembly 200. The radius of the concentric arrangement of the turning vane is less than the radius of the annular housing 107 of the axial fan assembly 100. When the turning vane assembly 200 is attached to the inlet end 109 of the annular housing 107 of the axial fan assembly 100, the central axis of the turning vane 216 assembly is aligned with the central axis of the annular housing 116 of the axial fan assembly 100 and the wind-turning vane(s) 201 extends away/outwardly from the axial fan assembly 100 beyond the inlet end 109 of the annular housing 107.

The concentrically arranged wind-turning vane(s) radially supported by frame members 203 (e.g. spokes or radial support members) which in turn are supported by an annular flange (not shown) or other attachment mechanism for attachment to the axial fan assembly 100. In a particularly preferred embodiment the spokes or radial support members of the wind turning vane are shaped to impart an inlet air rotation opposite the fan rotation thereby improving the axial fan performance by reducing the air flow rotational losses. Preferably the wind-turning vane assembly 200 is attached to the inlet end 109 of the annular housing 107 of the axial fan assembly 100. In another embodiment, the wind-turning vane assembly may be attached to the superior support structure or some other structure in contact with the axial fan assembly. In this latter embodiment, it is considered that the turning vane is attached to the axial fan assembly albeit through a secondary structure.

In another embodiment the wind-turning vane assembly 200 can be formed in pie-shaped sections about the frame members 203. In this embodiment, the wind-turning vane assembly 200 can be constructed and then shipped to and assembled (e.g. welded, bolted, glued, nailed, screwed or otherwise constructed and/or fit) at the site of application/attachment to the axial fan assembly 100.

The positioning of the wind-turning vane(s) 201 within the wind-turning vane assembly 200 are not particularly limited and can be selected depending upon the given application and in view of the teachings herein provided. In the embodiments shown in FIGS. 2A and 2B, the wind-turning vane assembly 200 comprises a plurality of wind-turning vanes 201 preferably forming complete concentric ring(s) about the axis 216 of the of the assembly. This is preferable for applications where wind direction is variable and the concentric placement of the axis 216 in an entire ring allows for the benefits of the turning vane assembly to be realized regardless of the wind direction and/or intensity. However, in other embodiments where the intended application site is located in a geographical area where there is a predominant wind direction (e.g. an application near the ocean, etc.) the wind-turning vane need not form a complete concentric ring about the axis 216 of the assembly 200. In these situations the wind-turning vane(s) 201 may be position at about 25 to 50% (e.g. about 33%) of the diameter of the respect concentric ring. In this latter embodiment, the turning vane assembly may be attached to the axial fan assembly such that the wind-turning vanes are disposed toward the predominant windward side of the inlet of the air passage 108 of the axial fan assembly 100. In other embodiments, where a plurality of axial fan assemblies are arranged in an array, some or all of the peripheral axial fan assemblies may be fitted with a wind-turning vane assemblies described herein, while the fan assemblies disposed toward in the interior are the array are not fitted with the turning vane assembly.

The shape and size of the wind-turning vane(s) 201 within the wind-turning vane assembly 200 are likewise not particularly limited. As shown in FIGS. 2A and 2B, the concentrically arranged wind-turning vane(s) 201 extends beyond/below the inlet end 109 of the annular housing 107. In an alternative embodiment shown in FIG. 2C, the wind-turning vane(s) 201 has a portion 205 extending into the air passageway 108 defined by the annular housing 107 and is preferably parallel to the axis 116 of the annular housing. In this embodiment each portion 205 provides an additional annular passage way for air to enter the annular housing 107, and thus a passageway for air to enter the windward side of the annular housing 107.

Figure 2C:
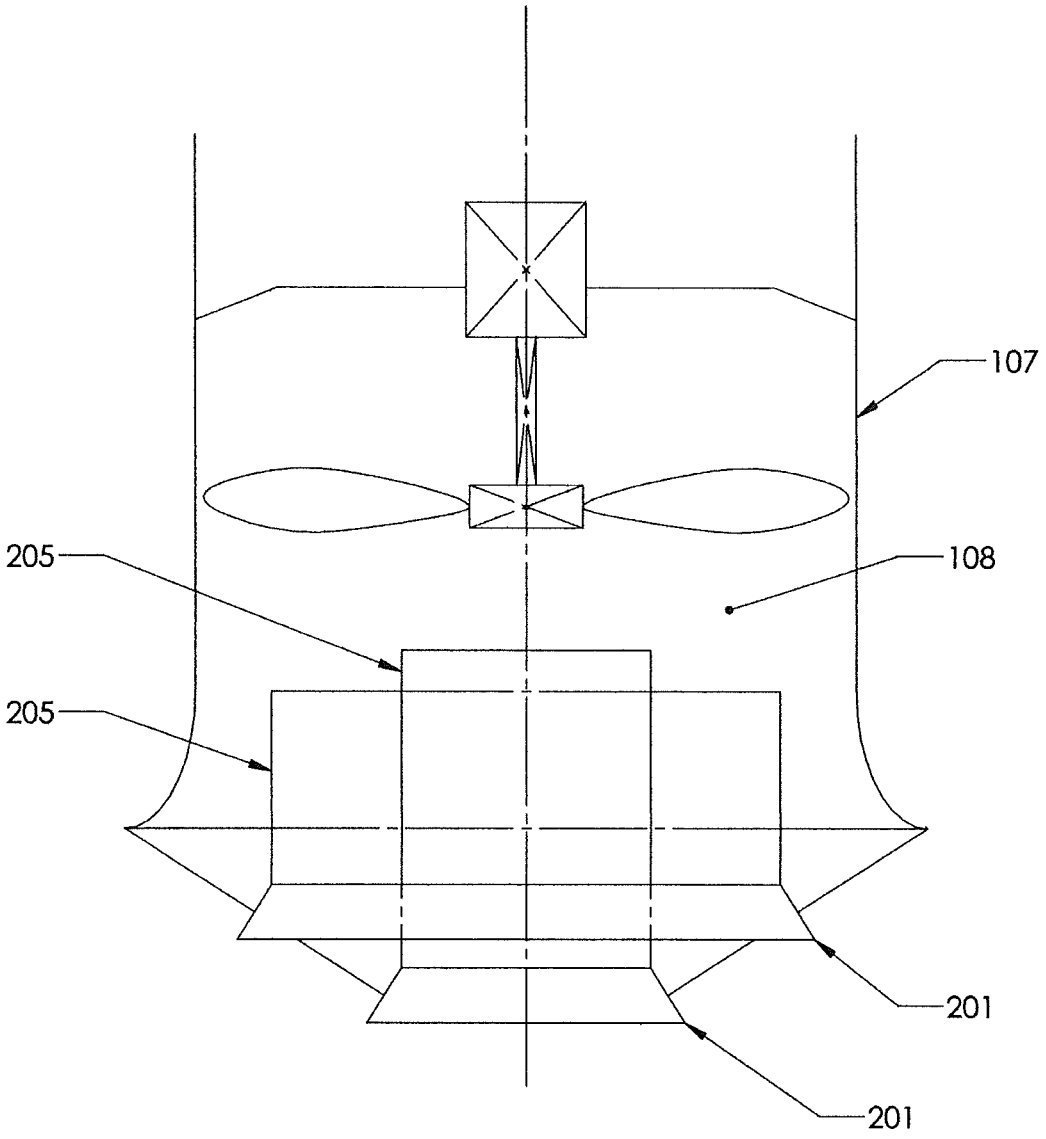
FIG. 2C is a side view of an axial fan assembly with a turning vane assembly according to the present invention.

As shown in FIGS. 2A-2C, the wind-turning vane(s) 201 extending beyond/below/adjacent the inlet end 109 of the annular housing 107 is positioned, or has a portion thereof that is positioned, at an oblique angle 207 with respect to the axis 116 of the annular housing 116/axis of the wind-turning vane assembly 216. In this embodiment, in addition to creating an elevated pressure at the windward side of the inlet end 109 air passageway 108, the wind can be directed into the windward side of the inlet. The oblique angle is preferably between 120° and 150° with respect to the axis of the annular housing and more preferably about 145° with respect to the axis of the annular housing.

Figure 2D:
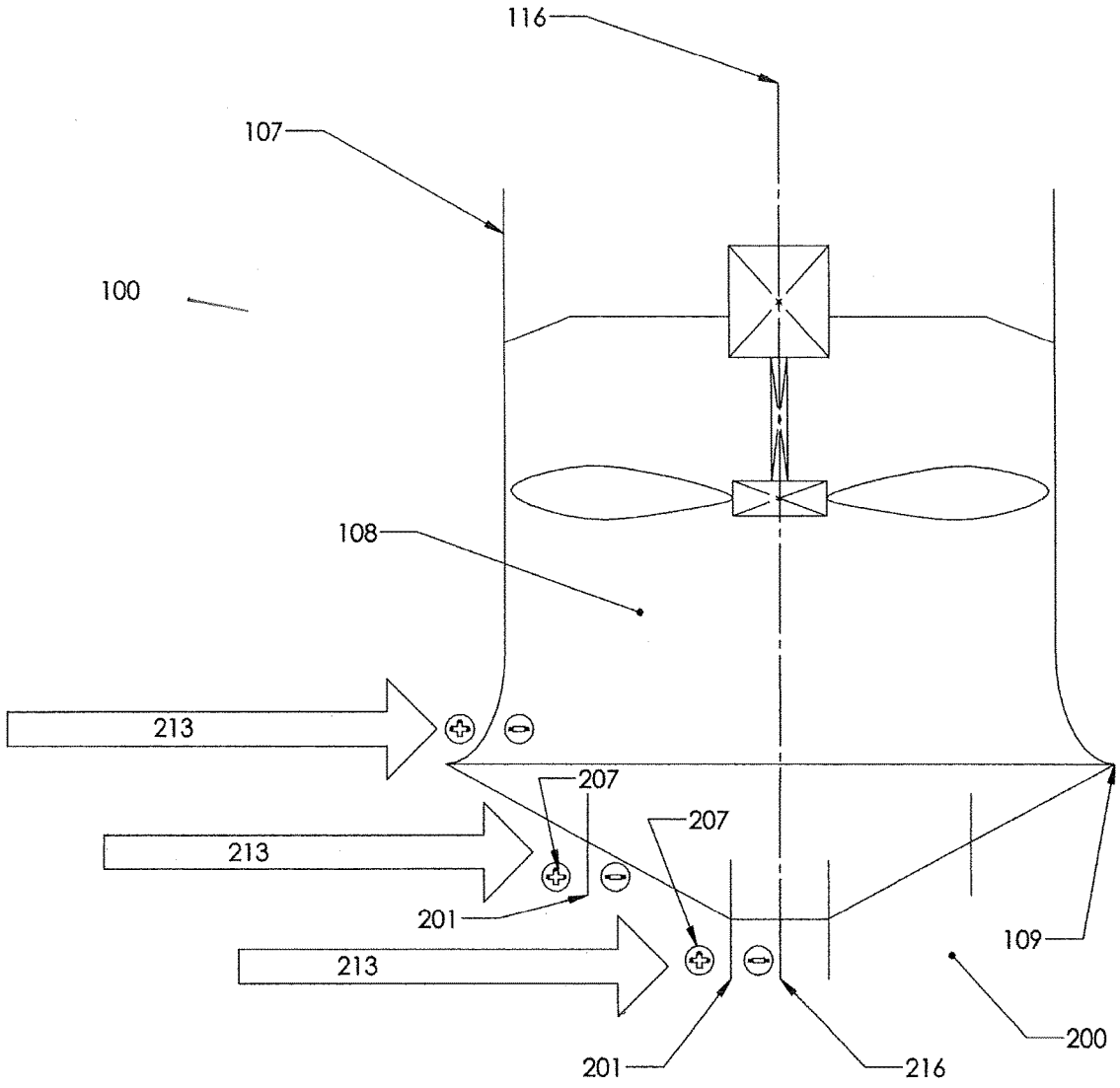
FIG. 2D is a side view of an axial fan assembly with a turning vane assembly according to the present invention.

In an additional embodiment shown in FIG. 2D the wind-turning vane(s) 201 of the wind-turning vane assembly 200 is positioned parallel to the axis of 216 of the turning vane assembly 200/the axis 116 of the annular housing 107 of the axial fan assembly 100. As shown in FIG. 2D wind 213 contacting the wind-turning vane(s) 201 creates a region of elevated pressure 207, as compared to ambient pressure, at the windward side of the air passageway 108 inlet end 109 defined by the annular housing 107. This causes air to flow into the windward side of the inlet of the annular passage way thereby reducing, eliminating, and/or otherwise overcoming the wind created pressure gradient within the annular housing 107 and thus solving the herein discovered problems associated with the wind-created air pressure gradient.

In the embodiments shown in FIGS. 2A-2D the turning vanes preferably have radii of concentric arrangement about the axis of the wind-turning vane assembly 200 and the annular housing 107 which is less than the radius of the annular housing 107. It is noted however, in other embodiments a portion of the turning vane may have a exterior/external radius which is larger than the radius of the annular housing. However in this later embodiment, the turning vane will also have a smaller internal radius which is preferably less than the radius of the exterior housing. Furthermore, as shown in FIGS. 2A-2D, where a plurality of turning vanes are present, the radii of concentric arrangement of each turning vane is different from another turning vane. Additionally, as shown in FIGS. 2A-2D where a plurality of turning vanes are present within the wind-turning vane assembly, each is preferably disposed at a different distances from the inlet end 109 of the annular housing 107.

The shape of the turning vane is preferably selected in combination with its position in the turning vane assembly to elevate or create the region of elevated air pressure at the windward side of the inlet. In some embodiments, the shape of the turning vane is selected from the group consisting of: flat, parabolic, elliptical, semicircular, and airfoil. In some preferred embodiment, the turning vane is airfoil shaped.

An Axial Fan Assembly:

In another aspect the present invention provides an axial fan assembly. In one embodiment, the Axial fan assembly preferably comprises an axial fan as described above coupled together with (e.g attached to) a wind-turning vane assembly as likewise described above. In another embodiment, the axial fan assembly comprises:

(i) a propeller-type impeller rotatably supported within an annular housing, the annular housing defining an air passageway from an air inlet end of the housing, across the impeller, and to an air outlet end of the housing, wherein rotation of the impeller within the annular housing causes air to flow into the air inlet end of the housing, along the air passageway, and out the air outlet of the housing, and (ii) a wind-turning vane assembly extending beyond the air inlet end of the annular housing, the turning vane assembly comprising a wind-turning vane concentrically arranged about the axis of the annular housing, wherein the radius of concentric arrangement of the turning vane is less than the radius of the annular housing.

The axial fan assembly is preferably positioned such that the annular housing and wind-turning vane assembly are exposed to environmental conditions including impaction thereof by wind. This can be accomplished inter alia by positioning the axial fan assembly outside. In such situations it is contemplated that the axial fan assemblies employing the wind-turning vane assemblies described herein do not require wind impaction protection (e.g. wind screens, secondary housings). Furthermore it is contemplated that the axial fan assemblies employing the wind-turning vane assemblies described herein can be operated near or at peak output during normal or elevated wind conditions without the aforementioned problems described above.

Figure 3:
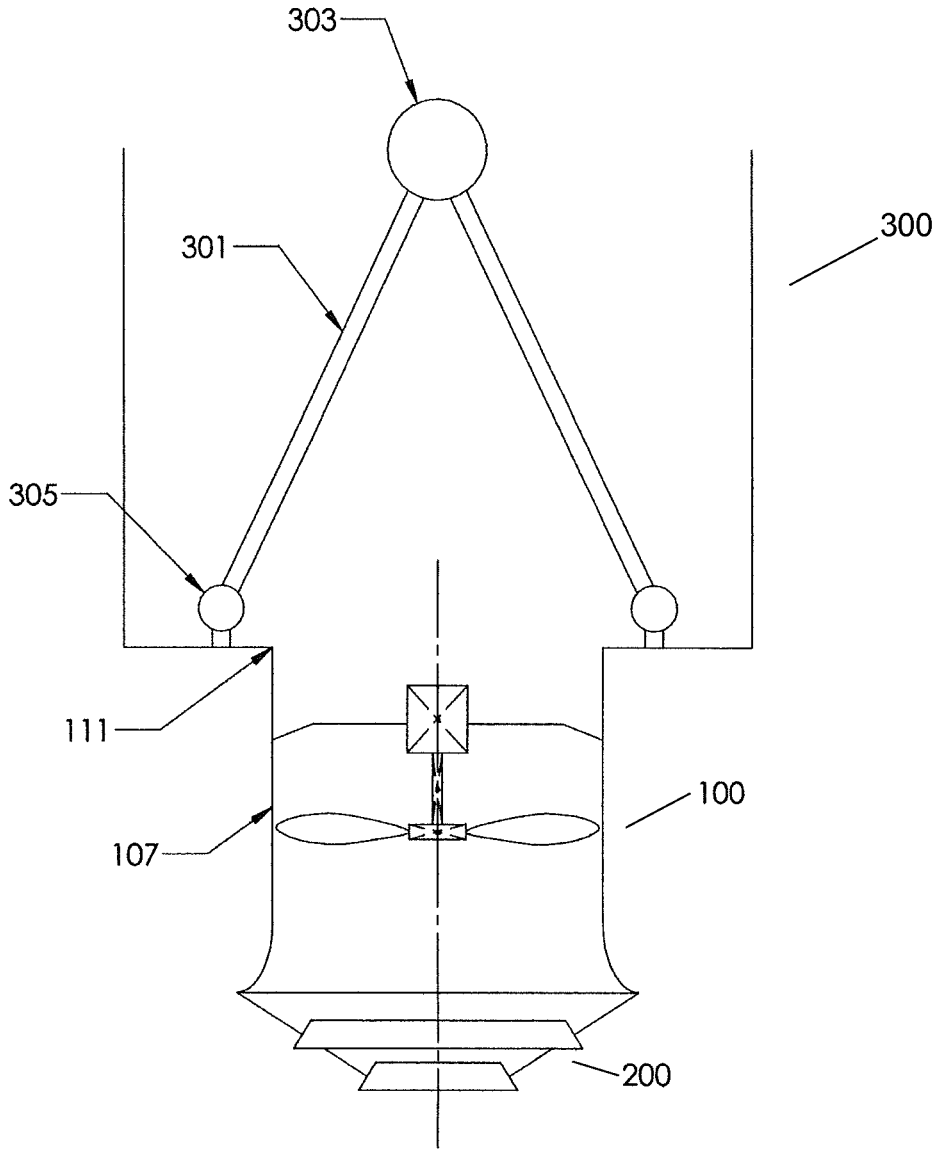
FIG. 3 is side view of an air-cooled steam condensing system employing an axial fan assembly with a turning vane assembly according to the present invention.

An Air-Cooled Heat Exchange or Condensing System:

The axial fan assembly employing the wind-turning vane assembly as shown and described herein can be employed for a variety of purposes, in a variety of locations, and in many different applications. As shown in FIG. 3, one such application thereof is in an air-cooled heat exchange system (e.g. an air-cooled steam condensing system 300 employed at an electric power generation facility or liquid natural gas compression facility). Air-cooled heat exchange systems include fin-fan coolers and air-cooled steam condenser heat exchangers wherein axial fan assemblies are positioned to force ambient outside air out of their outlets over the heat exchanger. The annular housing of axial fans for fin-fan cooler application typically have a diameter of about 5-10 feet while the diameter of the annular housing of the housing of axial fans of air-cooled condensers typically are between 24-36 feet. Other applications of axial fan assemblies can include ventilation systems (such as those required in mines or tunnels) where an axial fan assembly is positioned to force ambient/clean air into a mine shaft or tunnel where it is later purged at the other end of the shaft/tunnel as dirty air. In all these applications and others where the axial fan assembly is exposed to environmental conditions, the fan assemblies can experience problems caused by wind-turning into the inlet end of the axial fan assembly and likewise all considered applications can make beneficial use of the turning vane assembly(ies) herein described.

The axial fan non-axisymmetric intake air flow problems described above are not dependent on diameter of the fan. Axial fan airflow non-axisymmetric intake problems are also known to exist with small diameter computer cooling fans and small scale UAV fans.

As shown in FIG. 3, where the axial fan assembly is employed for air-cooled heat exchange with a process fluid (e.g. liquid or gas), the outlet end 111 of the annular housing 107 of the axial fan assembly 100 employing the wind-turning vane assembly 200 as shown and described above, is positioned to force air exiting the outlet end 111 of the annular housing 107 across a heat exchanger 301. The heat exchanger 301 has a heat exchange surface area (e.g. for example disposed between a steam inlet 303 and a water outlet 305).

In another embodiment, an air-cooled steam condensing system is provided that comprises:

(A) a heat exchanger having a heat exchange surface area (for example between a steam inlet and a liquid water outlet), and (B) an axial fan assembly comprising:

(i) a propeller-type impeller rotatably supported within an annular housing, the annular housing defining an air passageway from an air inlet end of the housing, across the impeller, and to an air outlet end of the housing, wherein rotation of the impeller within the annular housing causes air to flow into the air inlet end of the housing, along the air passageway, and out the air outlet of the housing, and (ii) a wind-turning vane assembly extending beyond the air inlet end of the annular housing, the turning vane assembly comprising a wind-turning vane concentrically arranged about the axis of the annular housing, wherein the radius of concentric arrangement of the wind-turning vane is less than the radius of the annular housing, wherein the outlet end of the annular housing of the (B) axial fan assembly is positioned to pass air exiting outlet end of the annular housing across the heat exchange surface area of the (A) heat exchanger.

In yet another embodiment the air-cooled steam condensing system comprises a plurality of axial fan assemblies arranged in an array. The outlet ends of the annular housing of each axial fan assembly in the array are positioned to pass air exiting the (B) axial fan assembly across the heat exchange surface area of the (A) heat exchanger or a plurality of heat exchangers.

An air-cooled steam condensing system including a plurality of axial fan assemblies arranged in an array will experience the wind induced problems described herein on those axial fan assemblies around the periphery of the array. Therefore, as noted above, in these arrays it is preferably that at least the axial fan assemblies about the periphery, or least those on the predominant windward side of the array, are configured with the wind-turning vane assemblies of the present invention.

In yet another embodiment, the present invention provides a method of using the air-cooled condensing systems and/or axial fan assemblies described here. In this embodiment, the impeller(s) of the axial fan assembly(ies) is rotated within the annular housing to cause air to flow into the air inlet end of the housing, along the air passageway, and out the air outlet of the housing. Furthermore, the annular housing and wind-turning vane assembly of the axial fan assembly are exposed to environmental conditions including impaction thereof by wind.

It is herein noted that other positioning of axial fan assemblies are known in the art for heat exchange purposes. For example axial fan assemblies may be employed in suction-type systems where the axial fan assembly is positioned within an outlet of an annular suction channel, space, or cavity so as to draw air (e.g. ambient air) into an inlet of the channel and across a heat exchange surface area disposed within the channel. In these arrangements the axial fan assembly is positioned at the end of suction channel such that the inlet end of the axial fan housing is disposed within and is protected by the super structure defining the channel. The outlet end of the axial fan housing is positioned such that effluent air from the channel and the axial fan is expelled from the channel (e.g. or returned to the atmosphere). Here the axial fan assembly inlet is typically protected from environmental conditions such as wind. However, the wind-turning vane assemblies of the present invention are still useful in these types of systems to smooth turbulent air inflow conditions caused by obstructions within the channel (e.g. heat exchange surface areas, etc).

Additional Methods of the Present Invention:

The present invention provides additional methods. These additional methods include the steps of: (I) providing an axial fan with the wind-turning vane assemblies described herein. The use of the combined axial fan and wind-turning vane are not particularly limited (e.g. heat exchange, ventilation, etc.). As described above, the introduction of the wind-turning vane assembly: reduces or eliminates wind-created impeller stress and/or failure; reduces or eliminates wind-created loss of efficiency of the axial fan; increases axial fan output velocity by turning wind in the direction of the outlet of the axial fan assembly.

Based upon the foregoing, the present invention provides methods for use with axial fans, including those for: (1) reducing or eliminating wind-created impeller stress and/or failure; (2) reducing or eliminating wind-created loss of efficiency of the axial fan; (3) increasing axial fan output velocity by turning wind in the direction of the outlet of the axial fan assembly. All of these methods include the step of: providing an axial fan with a wind-turning vane assembly described herein, thereby (1) reducing or eliminating wind-created impeller stress and/or failure; (2) reducing or eliminating wind-created loss of efficiency of the axial fan; and/or (3) increasing axial fan output velocity by turning wind in the direction of the outlet of the axial fan assembly.

Reference herein to one aspect or embodiment of the invention is herein understood to be illustrative of that portion of the invention described in that particular section. It will be herein understood that any aspects and/or embodiments may be combined with other aspects and/or embodiments.

The preferred embodiment contemplates one or more turning vanes that are arranged circularly concentric about the axial fan rotational axis. A less effective but still beneficial arrangement could be accomplished with a polygonal-shaped (e.g. rectangular, square, etc.) turning vane, or array of turning vanes, centered about the axis of the axial fan in accordance with the above descriptions regarding positioning and attachment, etc., of the turning vane assembly.

EXAMPLES

Having described the invention in detail, the following examples are provided. The examples should not be considered as limiting the scope of the invention, but merely as illustrative and representative thereof.

Axial Fan Wind-Turning Vane Bench Testing

Test Apparatus Description

Figure 4:
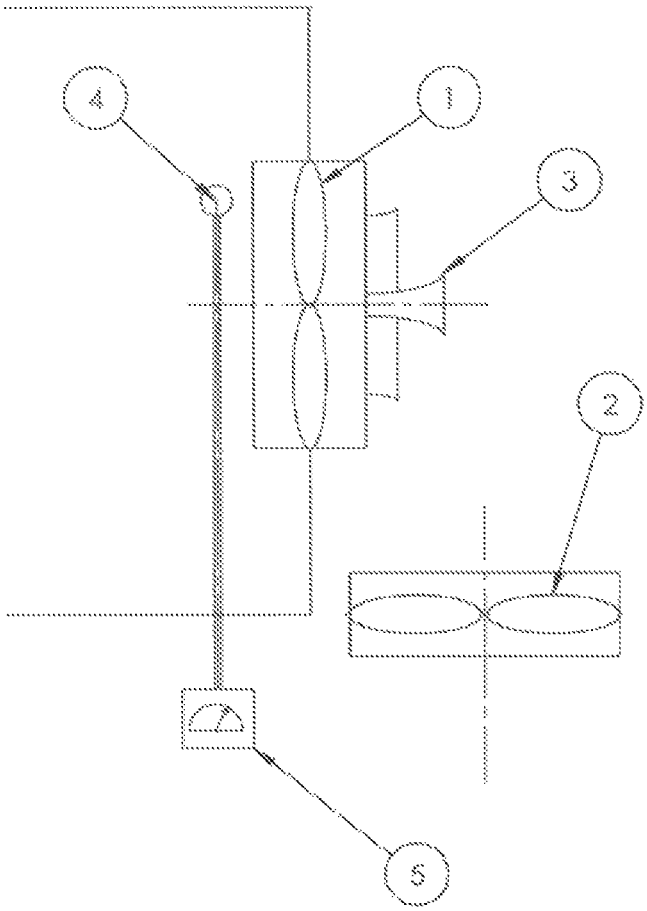
FIG. 4 is a top view of the test apparatus used and described in the Example Section of the application.

FIG. 4 shows a top view of a testing assembly having a plywood frame with transparent plexiglass top (not depicted). The testing assembly is divided into two sides via use of a central plywood divider. The left side is open to the room on the far left end. The right side is open to the room on the far right end and on the upper and lower walls. The plywood central divider has an axial fan (e.g. an 80 mm computer cooling fan, the "Primary Fan (1)) mounted in an opening allowing air to flow from the right to the left side of the apparatus when the Primary Fan (1) is operated.

The Primary Fan (1) output air flows across the Air Velocity Sensor (4) which is a Hot Wire Anemometer. The air flow across the Air Velocity Sensor (4) causes the electrical current through the Hot Wire Anemometer to vary which is measured at the Air Velocity Meter (5). The Primary Fan (1) output air velocity is turbulent which results in fluctuating Air Velocity Meter (5) readings. A pseudo steady state air velocity measurement is determined by averaging a representative sample of air velocity readings.

The Air Velocity Sensor (4) is mounted on a telescoping support and the position of the sensor is varied in ⅛" increments and a new representative sample of air velocity readings is taken. This process continues across the outlet face of the Primary Fan (1).

A graph is prepared with the Air Velocity Measurement Values plotted on the vertical axis with the corresponding incremental positions of the Air Velocity Sensor (4) is plotted on the horizontal axis.

The Secondary Fan (2) (e.g. another 80 mm computer cooling fan) is used to simulate a wind crossflow condition at the housing and inlet of the Primary Fan (1). In certain tests described below, an Axial Fan Wind-turning Vane (3) in accordance with an embodiment of the present invention is mounted to the inlet of the Primary Fan (1) to deflect the crossflow air from the Secondary Fan (2) into the Inlet of the Primary Fan (1).

Test Descriptions and Results

Figure 5:
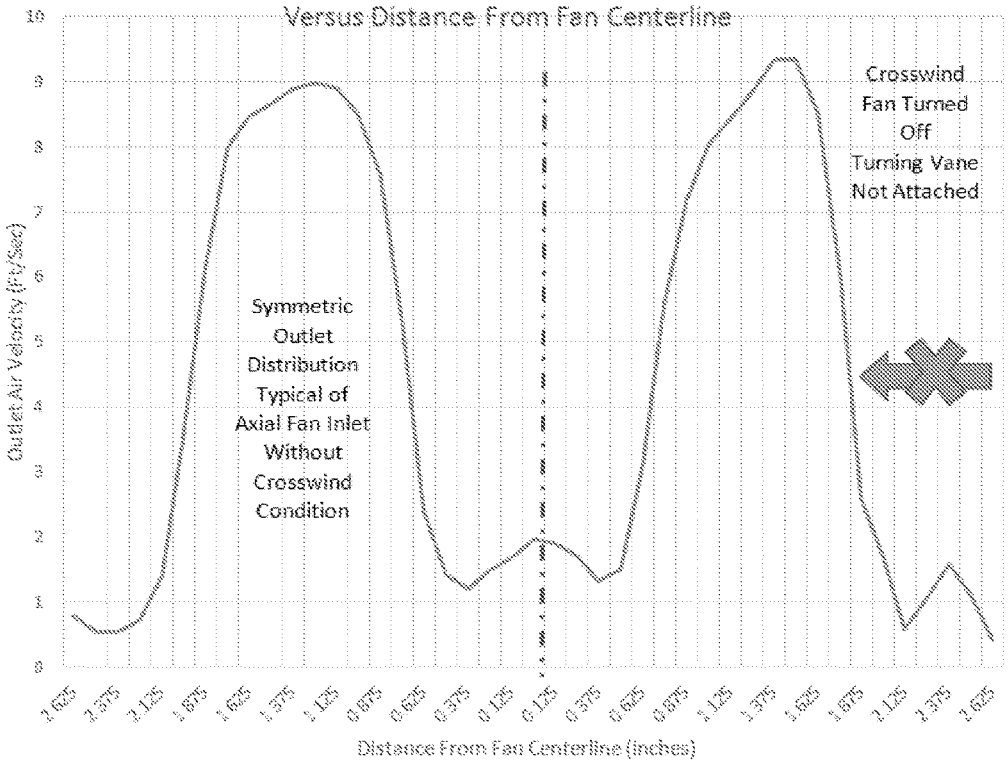

Test 1:

This test is a benchmark test. The Primary Fan (1) is operated with the Secondary Fan (2) turned off. The Axial Fan Wind-turning Vane (3) is not mounted on the Primary Fan (1) for this test. The Primary Fan (1) outlet air velocity was measured and plotted as shown in FIG. 5. The graph depicts a bimodal distribution of air velocity which is generally symmetrical about the axis if the Primary Fan (1). This demonstrates that the Primary Fan (1) inlet air flow condition is axi-symmetrical and the test apparatus is capable of detecting outlet air flow with sufficient accuracy and sensitivity to determine whether the Axial Fan Wind-turning Vane (3) will mitigate non-symmetrical outlet conditions caused by the crosswind fan inlet condition.

Test 2:

This test simulates the unmodified crosswind inlet condition. Both the Primary Fan (1) and the Secondary Fan (2) are operated simultaneously. The Axial Fan Wind-turning Vane (3) is not mounted on the Primary Fan (1) for this test. The Primary Fan (1) outlet air velocity was measured and plotted as shown in FIG. 6. The graph depicted a bimodal distribution of air velocity that has a distinct non-symmetrical distribution about the axis of the Primary Fan (1). This demonstrates that the Primary Fan (1) inlet air flow condition is non-axi-symmetrical. This non-axi-symmetrical condition is believed to be the root cause of wind borne axial fan blade vibration and fan blade structural failure. The Axial Fan Wind-turning Vane (3) is intended to mitigate the non-axi-symmetrical inlet and outlet air velocity condition.

Test 3:

This test was conducted to determine the impact of the Axial Fan Wind-turning Vane (3) when there is no crosswind effect. The Primary Fan (1) was operating while the Secondary Fan (2) was not operating. The Axial Fan Wind-turning Vane (3) is mounted on the inlet face of the Primary Fan (1) for this test. The Primary Fan (1) outlet air velocity was measured and plotted as shown in FIG. 7. The graph depicted a bimodal distribution of air velocity that has a symmetrical distribution about the axis if the Primary Fan (1). This demonstrates that the Primary Fan (1) inlet air flow condition is axi-symmetrical but at a reduced velocity as compared to test 1 (e.g. FIG. 5). This appears to indicate that the Axial Fan Wind-turning Vane (3) is causing an inlet air flow obstruction. Without being bound by a particular mechanism of action, it is believed that since the Axial Fan Wind-turning Vane (3) was designed for a different axial fan hub size than the hub of the test fan, the Axial Fan Wind-turning Vane (3) geometry was not optimized for the present fans tested. It is further believed that the placement, geometry, and/or sizing of the Axial Fan Wind-turning Vane (3) can be selected such that air flow obstruction under selected fan operating conditions can be reduced and/or eliminated.

Test 4:

This is a test of the effectiveness of the Axial Fan Wind-turning Vane (3). Both the Primary Fan (1) and the Secondary Fan (2) are operated simultaneously. The Axial Fan Wind-turning Vane (3) is mounted on inlet face of the Primary Fan (1) for this test. The Primary Fan (1) outlet air velocity was measured and plotted as shown in FIG. 8. The graph depicted a bimodal distribution of air velocity that has a nearly symmetrical distribution about the axis if the Primary Fan (1). This demonstrates that the Axial Fan Wind-turning Vane (3) mitigates crosswind fan inlet condition resulting in non-symmetrical outlet conditions and wind borne axial fan blade vibration and fan blade structural failure.

Test 4 further demonstrates the ability of the wind-turning vane to make use of kinetic energy of wind to increase the volumetric output of the fan. Without being bound by a particular mechanism of action, it is believed that the Axial Fan Wind-turning Vane (3) turns wind from its ambient direction (e.g. horizontal) into a direction which is substantially parallel to the axis of the annular housing of the axial fan thereby increasing volumetric output of the fan. Specifically comparing the results plotted in FIGS. 7 and 8, the output velocity of the Primary Fan (1) is increased when the Secondary Fan (2) is in operation simulating a cross-wind condition impacting the housing and Axial Fan Wind-turning Vane (3) of the Primary Fan (1).

Test 4, like Test 3, employs an Axial Fan Wind-turning Vane (3) designed for a different axial fan hub size than the hub of the test fan. Therefore, the Axial Fan Wind-turning Vane (3) placement, geometry, and sizing are not optimized for the Primary Fan (1) which was tested. It is nonetheless believed that when the placement, geometry, and/or sizing of the Axial Fan Wind-turning Vane (3) are selected and optimized specifically for the Primary Fan and its specifically contemplated operating conditions that air inflow obstruction caused by the Turning Vane (3) can be reduced and/or eliminated.

The invention claimed is:

1. An air-cooled heat exchange system comprising:

(A) a heat exchanger having a heat exchange surface area, (B) an axial fan assembly comprising:

(i) a propeller-type impeller rotatably supported within an annular housing, the annular housing defining an air passageway extending along a central axis of the housing from an air inlet end of the housing, then across the impeller, and then to an air outlet end of the housing, wherein rotation of the impeller within the annular housing causes air to flow into the air inlet end of the housing, along the air passageway, and out the air outlet of the housing, and (ii) a wind-turning vane assembly comprising a wind-turning vane having a portion extending beyond the air inlet end of the annular housing which is positioned at an oblique angle with respect to the axis of the annular housing, the wind-turning vane being concentrically arranged about the axis of the annular housing, wherein the radius of concentric arrangement of the wind-turning vane is less than the radius of the annular housing, and wherein the wind-turning vane is positioned to interact with the environmental condition of wind traveling in a direction not parallel to the axis of the annular housing to elevate air pressure at a windward side of the inlet end of the air passageway of the annular housing, wherein the outlet end of the annular housing of the (B) axial fan assembly is positioned to pass air exiting the outlet end of the annular housing across the heat exchange surface area of the (A) heat exchanger, and wherein the axial fan assembly is present outside and is positioned such that the annular housing and wind-turning vane assembly are exposed to the environmental condition of wind traveling in a direction not parallel to the axis of the annular housing.

2. The system of claim 1, wherein the concentrically arranged wind-turning vane has a portion extending into the air passageway defined by the annular housing.

3. The system of claim 2, where the portion of the wind-turning vane extending into the air passageway defined by the annular housing is positioned substantially parallel to the axis of the annular housing.

4. The system of claim 1, wherein the oblique angle is between 120° and 150° with respect to the axis of the annular housing.

5. The system of claim 1, wherein the concentrically arranged wind-turning vane has a portion extending beyond the inlet end of the annular housing that is positioned substantially parallel to the axis of the annular housing.

6. The system of claim 1, wherein the wind-turning vane assembly comprises a plurality of wind-turning vanes concentrically arranged about the axis of the annular housing, wherein the radii of concentric arrangement of the plurality of turning vanes are less than the radius of the annular housing and different from one another.

7. The system of claim 6, wherein each of the plurality of turning vanes are disposed at different distances from the inlet end of the annular housing.

8. The system of claim 1, wherein the system comprises a plurality of axial fan assemblies arranged in an array, wherein the outlet end of the annular housing of each axial fan assembly in the array is positioned to pass air exiting the (B) axial fan assembly across the heat exchange surface area of the (A) heat exchanger.

9. The system of claim 1, wherein the heat exchanger is a fin-fan cooler or an air-cooled condenser.

10. The system of claim 1, wherein the heat exchanger is used to condense steam exiting a electric power generation plant.

11. The air-cooled heat exchange system of claim 1, wherein the axis of the annular housing is vertical and the direction of the wind is horizontal.

12. The assembly of claim 1, wherein the propeller-type impeller is disposed entirely within the annular housing between the air inlet end of the housing and the air outlet end of the housing.

13. The system of claim 1, wherein the concentrically arranged wind-turning vane extends beyond the air inlet end of the annular housing and does not extend into the air inlet end of the annular housing.

14. An axial fan assembly comprising:

(i) a propeller-type impeller rotatably supported within an annular housing, the annular housing defining an air passageway extending along a central axis of the housing from an air inlet end of the housing, then across the impeller, and then to an air outlet end of the housing, wherein rotation of the impeller within the annular housing causes air to flow into the air inlet end of the housing, along the air passageway, and out the air outlet of the housing, and (ii) a wind-turning vane assembly comprising a wind-turning vane having a portion extending beyond the air inlet end of the annular housing which is positioned at an oblique angle with respect to the axis of the annular housing, the wind-turning vane being concentrically arranged about the axis of the annular housing, wherein the radius of concentric arrangement of the wind-turning vane is less than the radius of the annular housing, and wherein the wind-turning vane is positioned to interact with the environmental condition of wind traveling in a direction not parallel to the axis of the annular housing to elevate air pressure at a windward side of the inlet end of the air passageway of the annular housing, wherein the axial fan assembly is present outside and is positioned such that the annular housing and wind-turning vane assembly are exposed to the environmental condition of wind traveling in a direction not parallel to the axis of the annular housing.

15. The assembly of claim 14, wherein the concentrically arranged wind-turning vane has a portion extending into the air passageway defined by the annular housing.

16. The assembly of claim 15, where the portion of the wind-turning vane extending into the air passageway defined by the annular housing is positioned substantially parallel to the axis of the annular housing.

17. The assembly of claim 14, wherein the oblique angle is between 120° and 150° with respect to the axis of the annular housing.

18. The assembly of claim 14, wherein the concentrically arranged wind-turning vane has a portion extending beyond the inlet end of the annular housing that is positioned substantially parallel to the axis of the annular housing.

19. The assembly of claim 14, wherein the wind-turning vane assembly comprises a plurality of wind-turning vanes concentrically arranged about the axis of the annular housing, wherein the radii of concentric arrangement of the plurality of turning vanes are less than the radius of the annular housing.

20. The assembly of claim 19, wherein each of the plurality of turning vanes are disposed at different distances from the inlet end of the annular housing.

21. The assembly of claim 14, wherein the axis of the annular housing is vertical and the direction of the wind is horizontal.

22. The assembly of claim 14, wherein the propeller-type impeller is disposed entirely within the annular housing between the air inlet end of the housing and the air outlet end of the housing.

23. The assembly of claim 14, wherein the concentrically arranged wind-turning vane extends beyond the air inlet end of the annular housing and does not extend into the air inlet end of the annular housing.

24. A method of operation of an axial fan assembly, the method comprising:

(i) providing an axial fan assembly comprising (a) a propeller-type impeller rotatably supported within an annular housing, the annular housing defining an air passageway extending along a central axis of the housing from an air inlet end of the housing, then across the impeller, and then to an air outlet end of the housing, wherein rotation of the impeller within the annular housing causes air to flow into the air inlet end of the housing, along the air passageway, and out the air outlet of the housing, and (b) a wind-turning vane assembly comprising a wind-turning vane having a portion extending beyond the air inlet end of the annular housing which is positioned at an oblique angle with respect to the axis of the annular housing, the wind-turning vane being concentrically arranged about the axis of the annular housing, wherein the radius of concentric arrangement of the wind-turning vane is less than the radius of the annular housing, and wherein the wind-turning vane is positioned to interact with the environmental condition of wind traveling in a direction not parallel to the axis of the annular housing to elevate air pressure at a windward side of the inlet end of the air passageway of the annular housing, (ii) rotating the impeller within the annular housing to cause air to flow into the air inlet end of the housing, along the air passageway, and out the air outlet of the housing, and (iii) exposing the annular housing and wind-turning vane assembly of the axial fan assembly to the environmental condition of wind traveling in a direction not parallel to the axis of the annular housing.

25. The method of claim 24, further comprising the step of:

positioning the outlet end of the annular housing of the axial fan assembly to pass air exiting outlet end of the annular housing across a heat exchange surface area of a heat exchanger.

26. The method of claim 25, wherein the heat exchanger is a fin-fan cooler or an air-cooled condenser.

27. The method of claim 24, wherein the heat exchanger is used to condense steam from a electric power generation plant.

28. The method of claim 24, wherein the axis of the annular housing is vertical and the direction of the wind is horizontal.

29. The method of claim 24, wherein the propeller-type impeller is disposed entirely within the annular housing between the air inlet end of the housing and the air outlet end of the housing.

30. The method of claim 24, wherein the concentrically arranged wind-turning vane extends beyond the air inlet end of the annular housing and does not extend into the air inlet end of the annular housing.

31. A method of operation of an axial fan assembly, the method comprising:

(i) providing an axial fan assembly having a propeller-type impeller rotatably supported within an annular housing, the annular housing defining an air passageway extending along a central axis of the housing from an air inlet end of the housing, then across the impeller, and then to an air outlet end of the housing, (ii) rotating the impeller within the annular housing to cause air to flow into the air inlet end of the housing, along the air passageway, and out the air outlet of the housing, (iii) exposing the axial fan assembly to the environmental condition of wind traveling in a direction not parallel to the axis of the annular housing thereby creating a windward side of the annular housing, and (iv) using the force of the wind to elevate air pressure at the windward side of the inlet end of the air passageway of the annular housing, wherein step (iv) is accomplished by use of a wind-turning vane assembly, wherein the wind-turning vane assembly comprises a wind-turning vane concentrically arranged about a central axis of the wind-turning vane assembly, wherein:

the radius of the concentric arrangement of the turning vane is less than the radius of the annular housing of the axial fan assembly; and the central axis of the wind-turning vane assembly is aligned with the axis of the annular housing of the axial fan assembly and the wind-turning vane has a portion extending from the axial fan assembly beyond the inlet end of the annular housing which is positioned at an oblique angle with respect to the axis of the annular housing.

32. The method of claim 31, further comprising the step of:

(v) using the force of the wind to decrease air pressure at the leeward side of the inlet end of the air passageway of the annular housing.

33. The method of claim 31, further comprising the step of:

(v) using the force of the wind to increase volumetric output of the axial fan assembly.

34. The method of claim 31, wherein the axis of the annular housing is vertical and the direction of the wind is horizontal.

35. The method of claim 31, wherein the propeller-type impeller is disposed entirely within the annular housing between the air inlet end of the housing and the air outlet end of the housing.

36. The method of claim 31, wherein the concentrically arranged wind-turbine vanes extends beyond the air inlet of the annular housing and does not extend into the air inlet of the annular housing.

* * * * *